US011535428B2

(12) United States Patent
McCumber

(10) Patent No.: US 11,535,428 B2
(45) Date of Patent: Dec. 27, 2022

(54) TAMPER EVIDENT RECLOSABLE CONTAINER

(71) Applicant: Placon Corporation, Madison, WI (US)

(72) Inventor: Donald E. McCumber, Madison, WI (US)

(73) Assignee: PLACON CORPORATION, Madison, WI (US)

( * ) Notice: Subject to any disclaimer, the term of this patent is extended or adjusted under 35 U.S.C. 154(b) by 279 days.

(21) Appl. No.: 16/930,814

(22) Filed: Jul. 16, 2020

(65) Prior Publication Data

US 2022/0017270 A1 Jan. 20, 2022

(51) Int. Cl.
*B65D 43/02* (2006.01)
*B65D 51/16* (2006.01)

(52) U.S. Cl.
CPC ..... *B65D 43/0249* (2013.01); *B65D 51/1688* (2013.01); *B65D 2543/005* (2013.01); *B65D 2543/00092* (2013.01); *B65D 2543/00296* (2013.01); *B65D 2543/00537* (2013.01); *B65D 2543/00555* (2013.01); *B65D 2543/00685* (2013.01); *B65D 2543/00796* (2013.01); *B65D 2543/00842* (2013.01)

(58) Field of Classification Search
CPC ..... B65D 43/0249; B65D 51/1688; B65D 2543/005; B65D 2543/00537; B65D 43/0235; B65D 43/0243; B65D 43/0237; B65D 43/0258; B65D 43/065
See application file for complete search history.

(56) References Cited

U.S. PATENT DOCUMENTS

| | | | | |
|---|---|---|---|---|
| 4,721,210 | A | 1/1988 | Lawrence et al. | |
| 6,170,696 | B1 * | 1/2001 | Tucker | B65D 43/0208 206/508 |
| 7,055,712 | B2 | 6/2006 | Tang | |
| 7,097,066 | B2 | 8/2006 | Tucker et al. | |
| 7,631,776 | B2 | 12/2009 | Vovan et al. | |
| 8,011,566 | B2 | 9/2011 | Robertson et al. | |

(Continued)

FOREIGN PATENT DOCUMENTS

WO 9808748 A1 3/1998

OTHER PUBLICATIONS

"TamperSmart Containers & Lids," https://www.dwfinepack.com/wp-content/uploads/TamperSmart-Oct-2018.pdf, downloaded Mar. 19, 2020.

*Primary Examiner* — Jeffrey R Allen
(74) *Attorney, Agent, or Firm* — Stiennon & Stiennon

(57) ABSTRACT

A tamper-evident container has a lid with a rim with a bead mating with a groove in a base rim. The rim bead is interrupted by a tab wall which does not engage the base. The lid has a first flange portion which overlies a base flange. The base and lid first flange portions extend outwardly about the same amount. At the tab, a second portion of the lid flange extends substantially outwardly beyond the base flange. The flange second portion is connected to the first portion on both sides of the tab by weakened lines of material which extend cut lines through the tab front wall. The tab second flange portion is engageable to sever the weakened lines of material and pivot the tab upwardly to remove the lid, thus deforming it and evidencing tampering should the lid be replaced on the base. Base vents reduce ballooning when closed.

20 Claims, 5 Drawing Sheets

(56) References Cited

U.S. PATENT DOCUMENTS

| | | | | |
|---|---|---|---|---|
| 8,083,089 | B2 | 12/2011 | Vovan | |
| 8,186,531 | B2 | 5/2012 | Parikh et al. | |
| 8,251,242 | B2 | 8/2012 | Vovan | |
| 8,322,553 | B2 | 12/2012 | Rider, Jr. et al. | |
| 8,757,416 | B2 | 6/2014 | Golota et al. | |
| 8,695,831 | B2 | 8/2014 | Schick | |
| 8,869,985 | B2 | 10/2014 | Schick | |
| 9,156,595 | B2 | 10/2015 | Pace et al. | |
| 9,187,209 | B1 | 11/2015 | Hanna et al. | |
| 9,315,302 | B2 | 4/2016 | Stone et al. | |
| 9,663,275 | B2 | 5/2017 | Chisholm | |
| 9,745,106 | B2 | 8/2017 | Siskindovich et al. | |
| 9,796,511 | B2 | 10/2017 | Cimmerer et al. | |
| 10,279,962 | B2 | 5/2019 | Hansen et al. | |
| 10,611,528 | B2 | 4/2020 | Hansen et al. | |
| 2004/0096552 | A1 | 5/2004 | Thomas et al. | |
| 2004/0118848 | A1 | 6/2004 | Marshall | |
| 2007/0045317 | A1 | 3/2007 | Rosender et al. | |
| 2007/0062949 | A1 | 3/2007 | Bordner | |
| 2007/0251913 | A1 | 11/2007 | Mengeu | |
| 2010/0084400 | A1* | 4/2010 | Juliani | B65D 43/0235 220/270 |
| 2010/0084401 | A1 | 4/2010 | Golota et al. | |
| 2010/0147848 | A1* | 6/2010 | Rider, Jr. | B65D 43/021 220/745 |
| 2012/0118888 | A1 | 5/2012 | Albrecht et al. | |
| 2012/0292323 | A1 | 11/2012 | Young | |
| 2015/0266611 | A1 | 9/2015 | Dow et al. | |
| 2016/0046415 | A1 | 2/2016 | Buck | |
| 2016/0101907 | A1 | 4/2016 | Blackmore et al. | |
| 2018/0178952 | A1 | 6/2018 | Yeagley et al. | |
| 2019/0062009 | A1 | 2/2019 | Georgiadis et al. | |
| 2020/0062461 | A1 | 2/2020 | Smith et al. | |

* cited by examiner

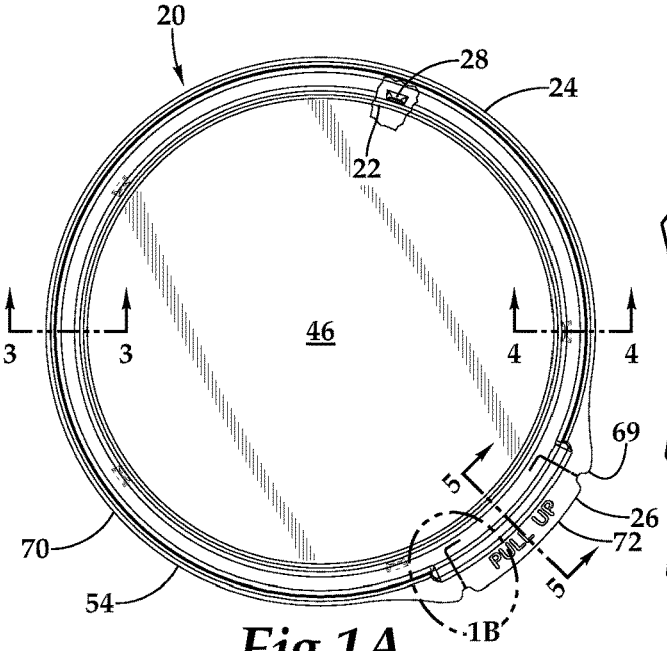
Fig.1A
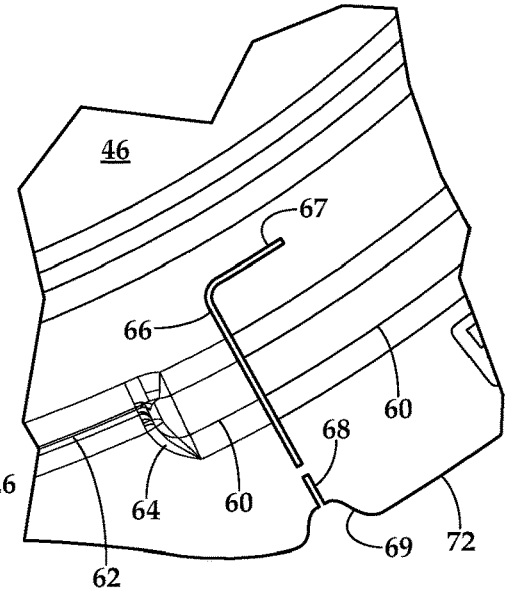
Fig.1B
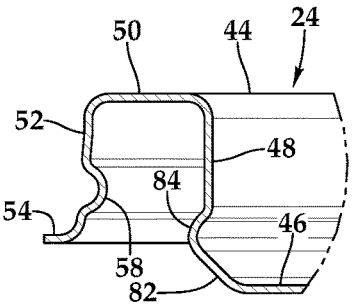
Fig.2A
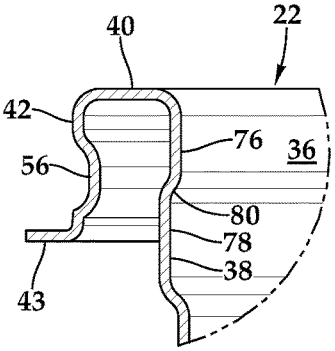
Fig.2B
Fig.2
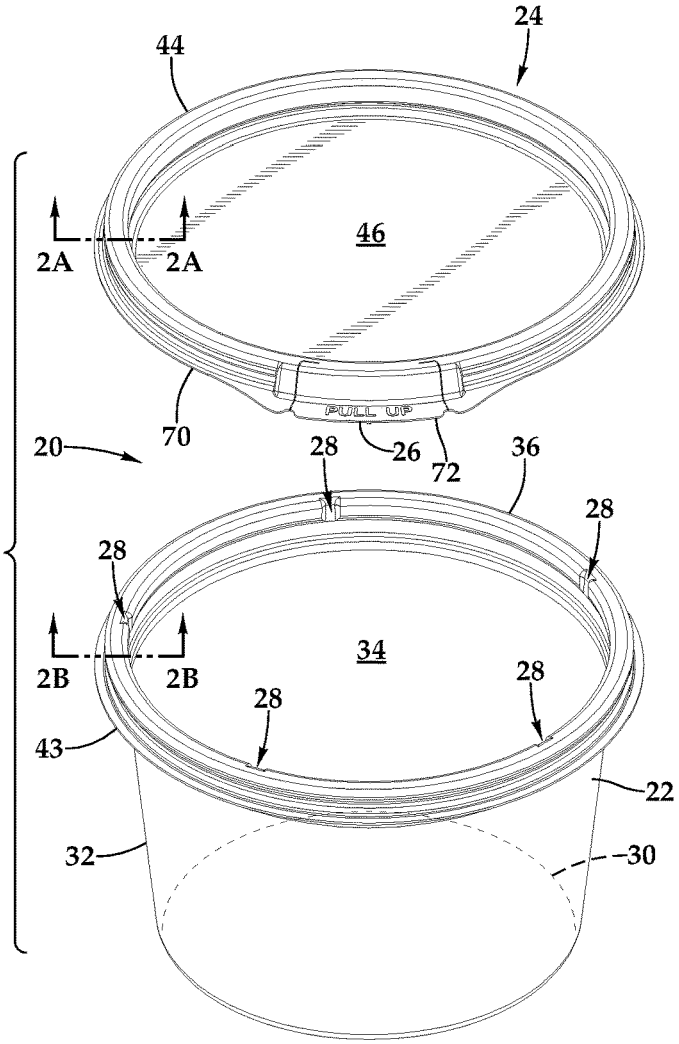

TAMPER EVIDENT RECLOSABLE CONTAINER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to reclosable containers in general, and more particularly to containers having elements which indicate that the container has been opened after its original closure.

There are a number of consumer products, such as bakery or deli foods, which are placed in containers which are closed and put on display for consumer selection. This type of merchandizing can reduce retailer labor and allow consumers to select the products they desire at their own pace. However, particularly with consumable foodstuffs, customers may seek some assurance that the products they are purchasing have not been tampered with or been pilfered by others. This can be done by applying a shrink-wrapped plastic band to the sealed container, although this requires special equipment and can add cost, and the application process can compromise the contents, and require additional disposable plastic material.

Containers are also known which employ press-fit connectors on the container base and lid which engage with one another when the container is closed to retain the container in a closed configuration. Weakened regions of material such as perforations are disposed such that the force necessary to open the lid causes portions of the container to be severed, either to be separated from the container or to be retained on an opposed container part. Such arrangements provide evidence of tampering either due to the absence of some package part, or due to the open condition of the container. Yet for the untrained observer, the absence of a container part may not immediately indicate tampering, and, although an open container is readily understood, customers may wish to have containers that are reclosable for retention of partial quantities of product.

What is needed is an economical container that effectively presents consumer merchandise, is reclosable, and which clearly indicates that it has been opened after its initial closure.

SUMMARY OF THE INVENTION

The container of this invention has a lid with a rim with a bead mating with a groove in a base rim. The rim bead is interrupted by a tab wall which does not engage the base. The lid has a first flange portion which overlies a base flange. The base and lid first flange portions extend outwardly about the same amount. At the tab, a second portion of the lid flange extends substantially outwardly beyond and overlying the base flange. The second portion is connected to the first flange portion on both sides of the tab by weakened lines of material which extend from cut lines in the tab front wall. A user can grip the tab second flange portion and pull up to remove the lid from the base, and, in doing so, sever the weakened lines of material and pivot the tab upwardly to remove the lid. The upward pivoting of the tab which is required to remove the lid from the base, causes plastic deformation of the tab where it extends from the lid. Thus, although the lid can be replaced on the base to reseal it, the tab will not return to its original undeformed condition, giving clear evidence of tampering. Multiple vertical grooves define vents which extend upwardly in a peripheral rim of the base. These vents allow the escape of air when the lid is sealed on the base, reducing ballooning of the sealed container.

It is an object of the present invention to provide a container with a lid, the removal of which causes deformation thereof which gives evidence of removal.

It is a further object of the present invention to provide a tamper evident container which readily vents air when the lid is pressed into place.

Further objects, features and advantages of the invention will be apparent from the following detailed description when taken in conjunction with the accompanying drawings.

BRIEF DESCRIPTION OF THE DRAWINGS

FIG. 1A is a top plan view of the tamper evident container of this invention.

FIG. 1B is an enlarged fragmentary top plan view of the region 1B indicated in FIG. 1A.

FIG. 2 is an exploded axonometric view of the container of FIG. 1A.

FIG. 2A is a fragmentary cross-sectional view of the lid of the container of FIG. 2 taken along section line 2A-2A.

FIG. 2B is a fragmentary cross-sectional view of the base of FIG. 2 taken along section line 2B-2B.

DESCRIPTION OF THE PREFERRED EMBODIMENTS

Figure 4:
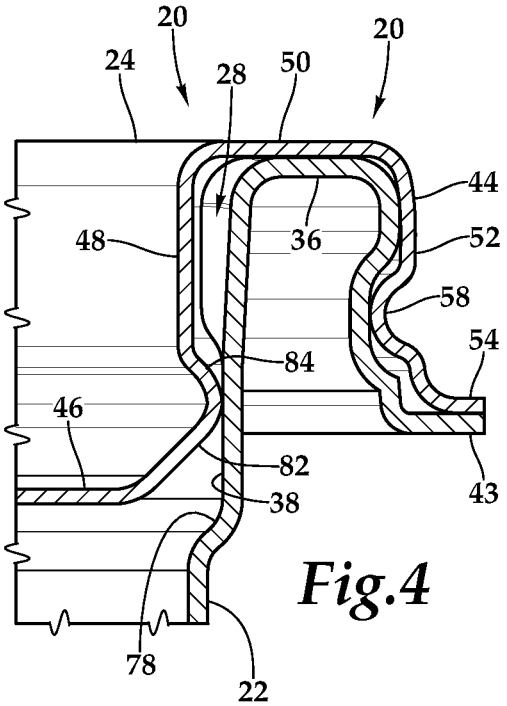
FIG. 4 is a fragmentary cross-sectional view of the container of FIG. 1A taken along section line 4-4.
Figure 5:
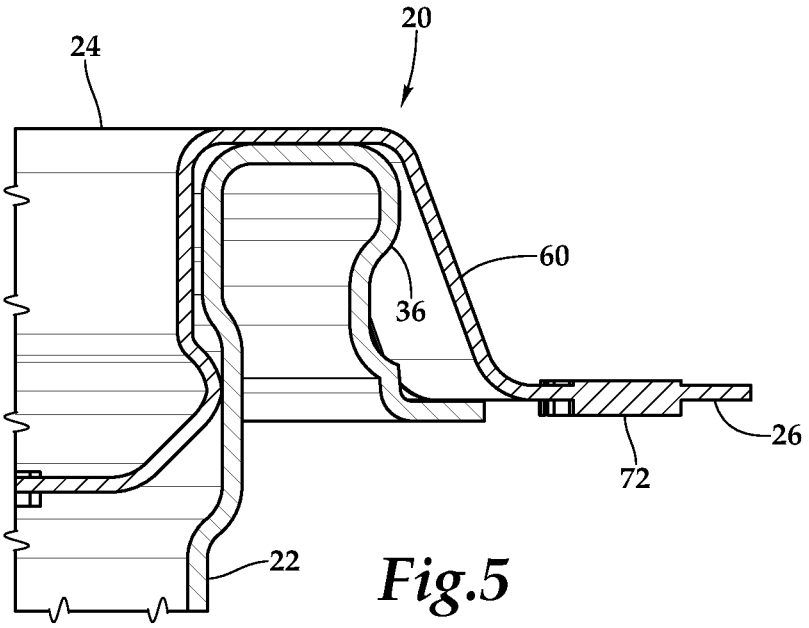
FIG. 5 is a fragmentary cross-sectional view of the container of FIG. 1A taken along section line 5-5.
Figure 6:
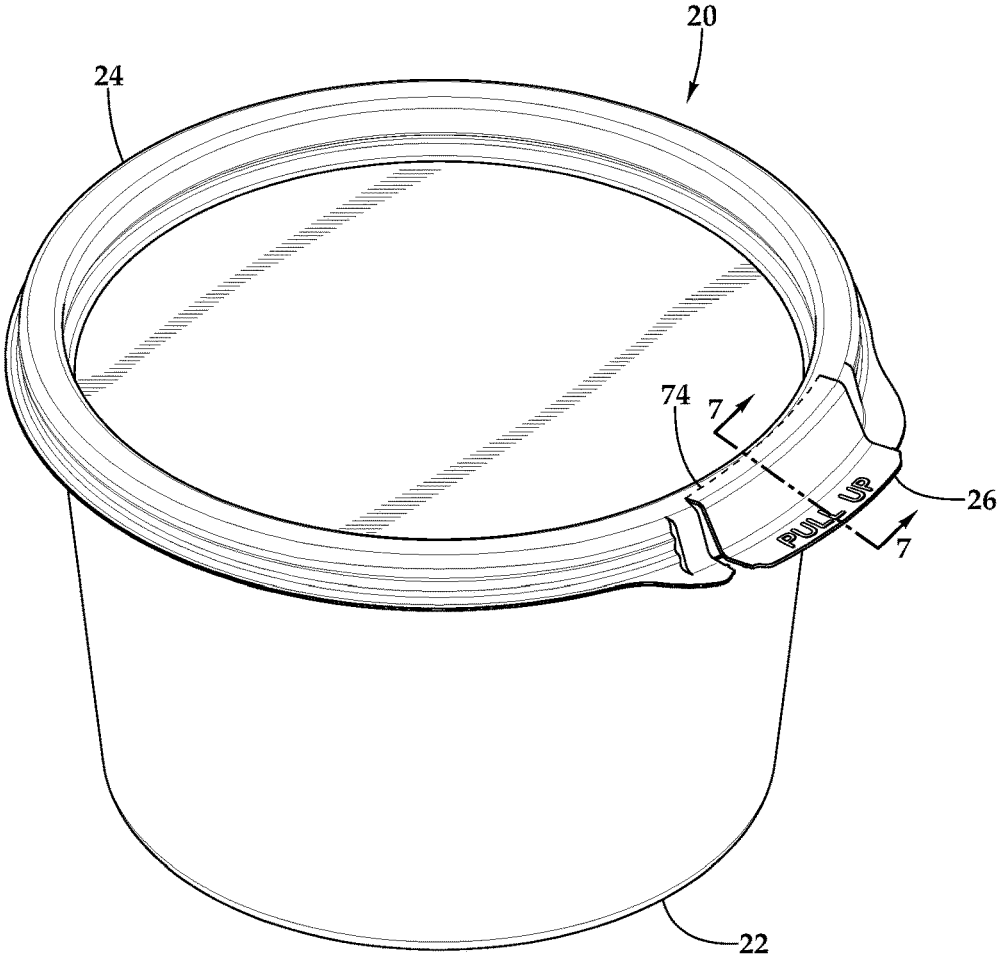
FIG. 6 is an isometric view of the container of FIG. 1A in an opened configuration giving evidence of tampering.
Figure 7:
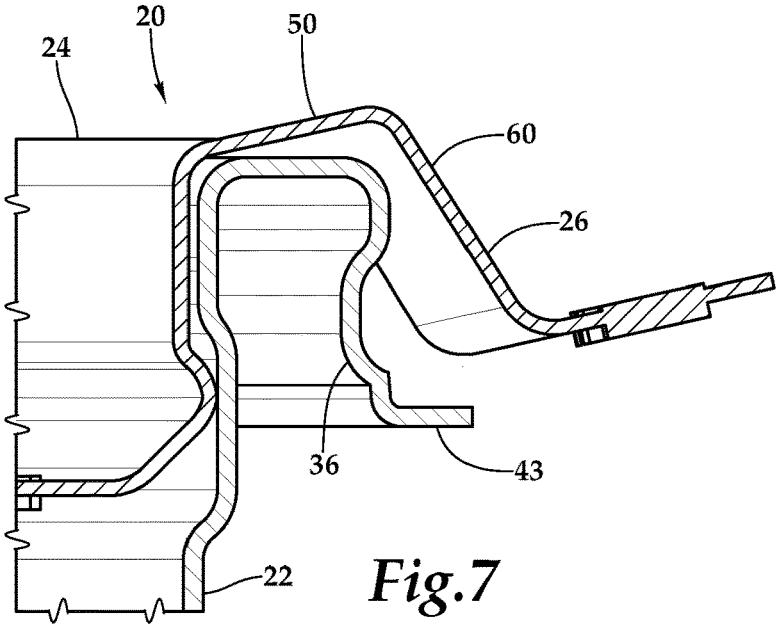
FIG. 7 is a fragmentary cross-sectional view of the container of FIG. 6 taken along section line 7-7.
Figure 8:
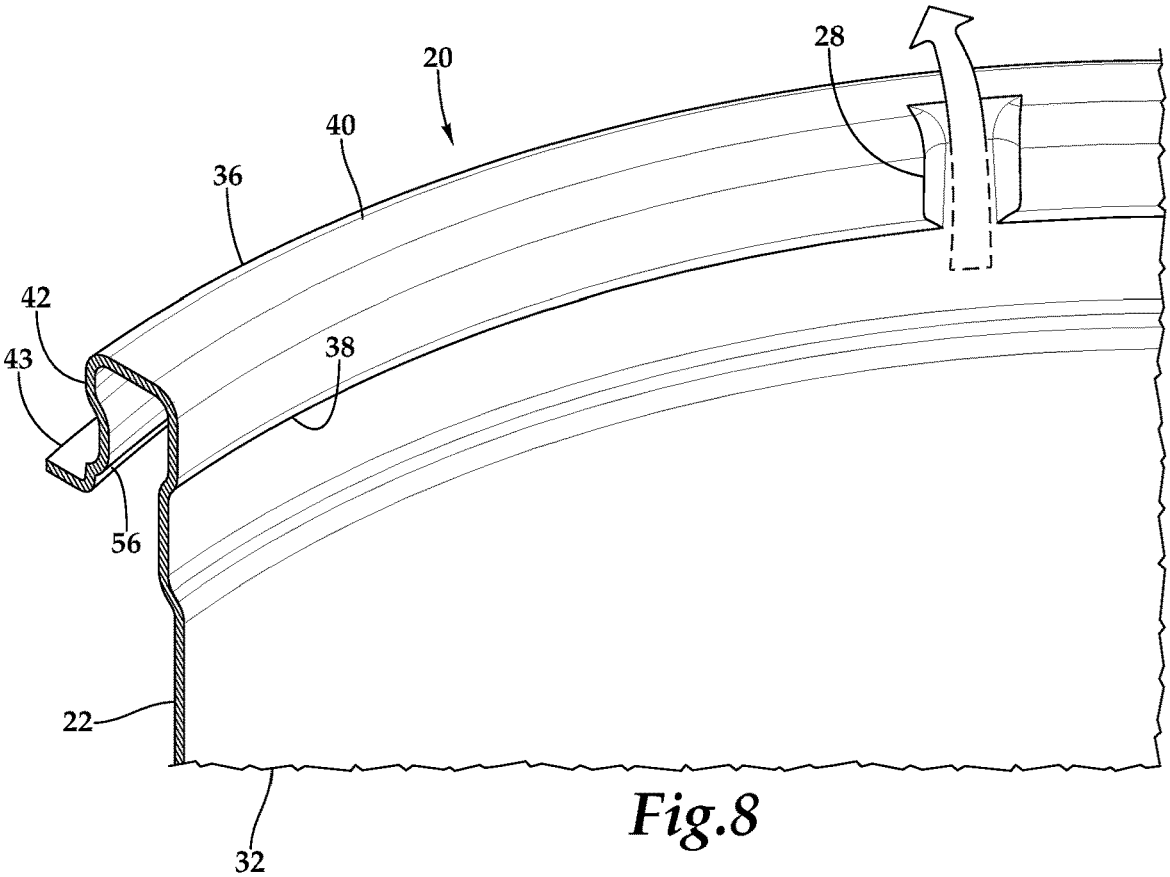
FIG. 8 is a fragmentary perspective view of the rim of the container base of FIG. 1A, with an illustration of air flow through a vent.

Referring more particularly to FIGS. 1-11 wherein like numbers refer to similar parts, a container 20 is shown in FIG. 2 which has a base 22 and a removable lid 24 which is attached to the base with a spill-resistant seal. Both the base 22 and the lid 24 are preferably formed in the thermoforming process from thin sheets of plastic material, for example Polyethylene terephthalate (PET). The lid 24 has a pull tab 26 by which a user may readily engage the lid and pull it free of the base. The force of pulling the tab 26 causes portions of the tab to separate from surrounding portions of the lid, giving clear evidence that the lid has been removed, as shown in FIGS. 6 and 7. Vents 28 are provided in the base 22 to assist in the initial closure of the lid 24 on the base. The container 20 may be, for example, a deli container. In a preferred embodiment, the same lid may be used with various sized bases, for example, 8, 12, 16, 24 and 32 ounce base cups.

Figure 9:
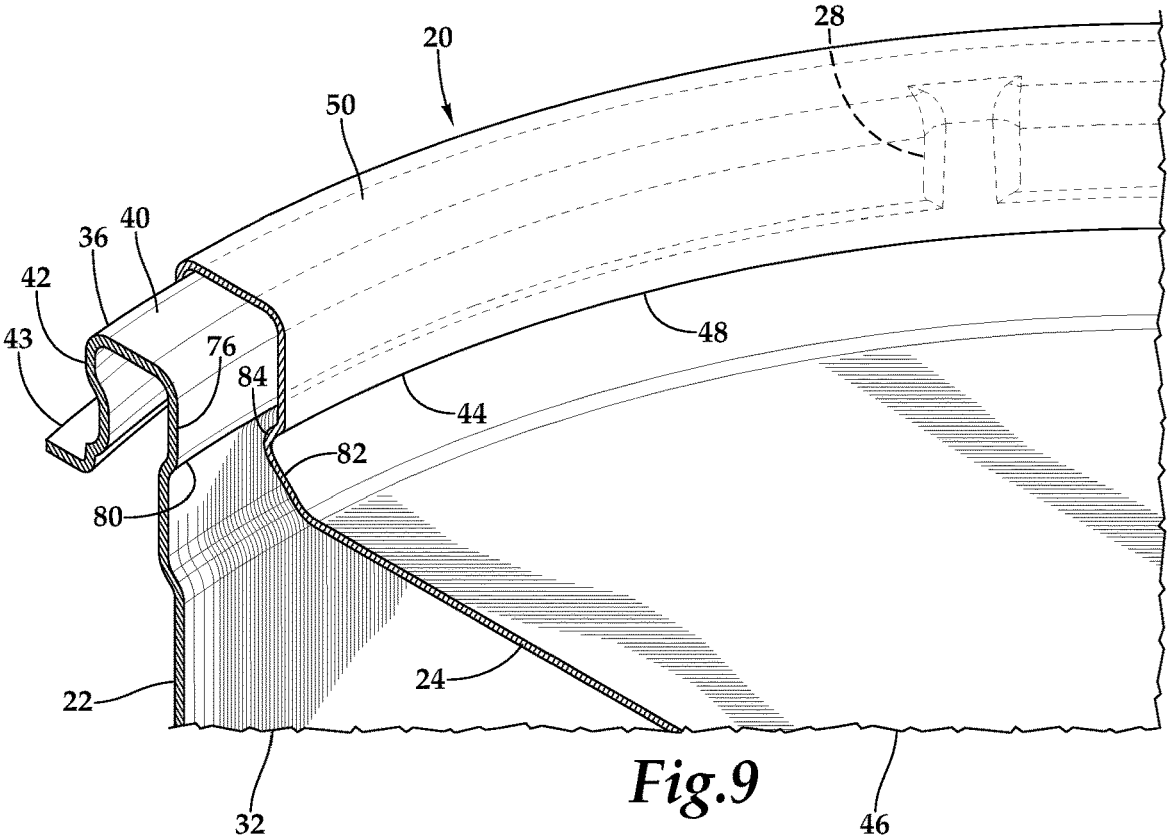
FIG. 9 is a fragmentary perspective view of the container base of FIG. 8 with its lid closed thereon.
Figure 10:
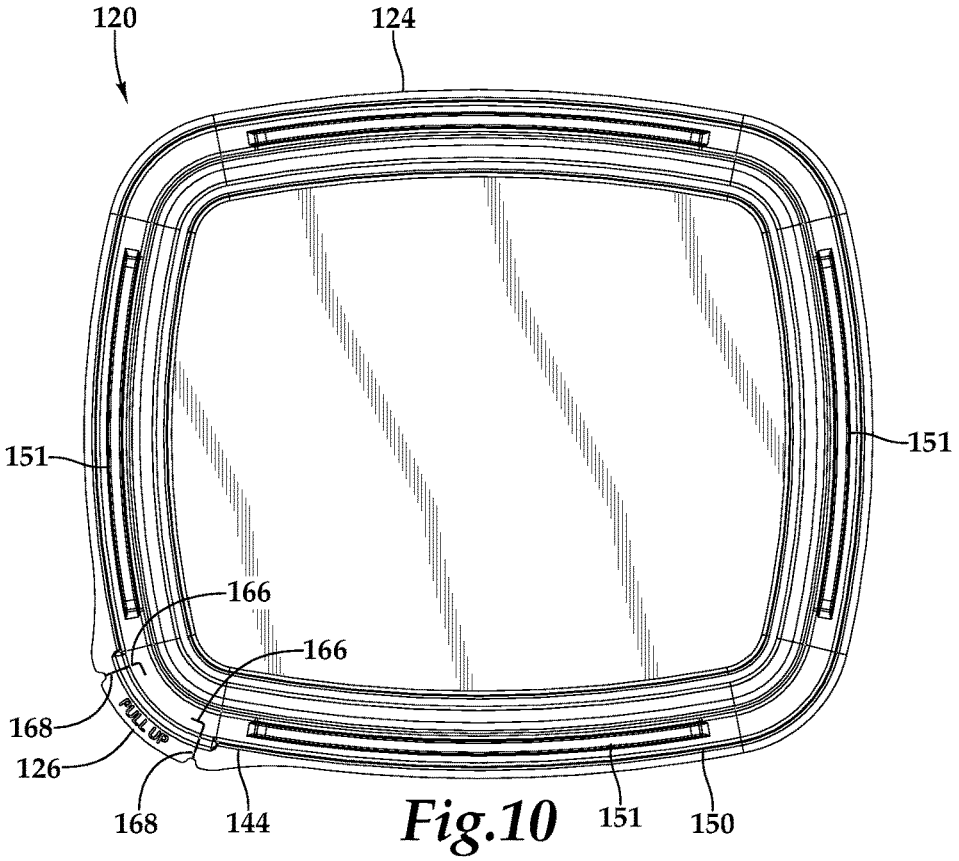
FIG. 10 is a top plan view of an alternative embodiment tamper evident container of this invention having a generally rectangular shape.
Figure 11:
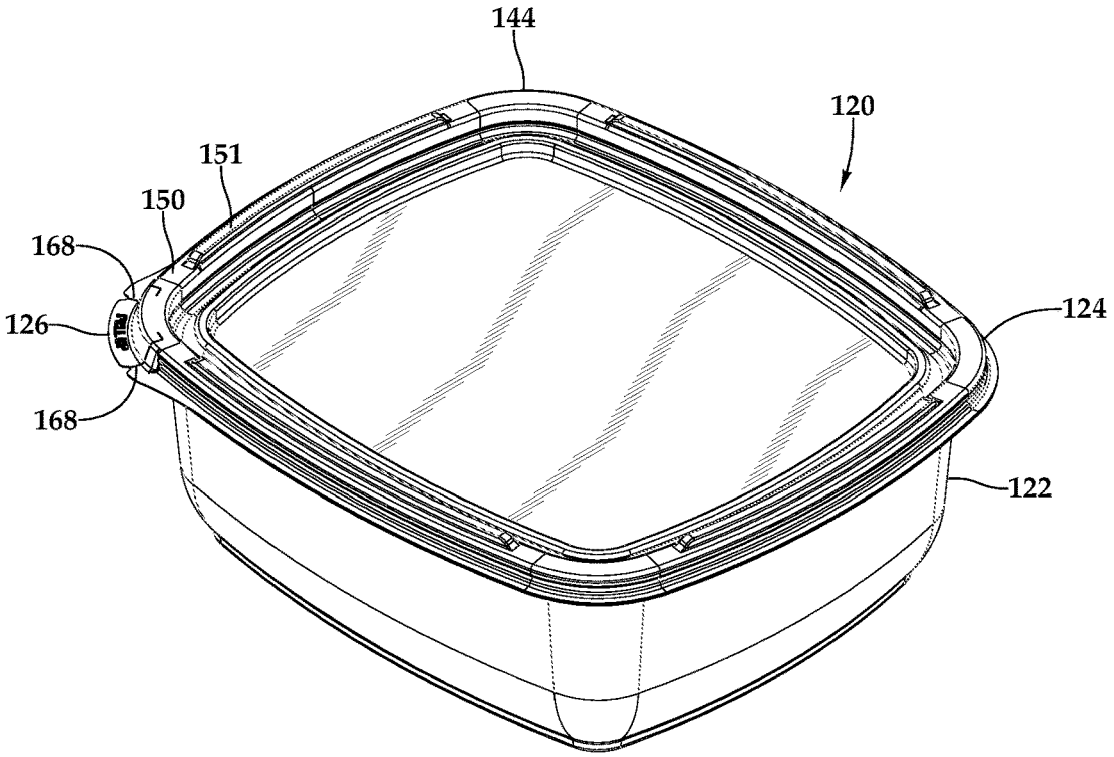
FIG. 11 is a perspective view of the container of FIG. 10.

As shown in FIG. 2 the base 22 has a bottom wall 30 with a side wall 32 which extends upwardly from the bottom wall, and with the bottom wall defines a base interior 34. The container base 22 may have a generally cylindrical or frustoconical form as shown in FIGS. 1-9, but may have a rectangular form as well as shown in FIGS. 10 and 11. As shown in FIG. 2B, a rim 36 surrounds the base 22 and extends outwardly from the side wall 32. The rim 36 has an inside wall 38 which extends upwardly from the base side wall 32 to an upper wall 40, and an outside wall 42 which descends from the upper wall and which terminates in an outwardly extending flange 43.

The lid 24 has a peripheral rim 44, shown in FIG. 2A, which extends upwardly and outwardly from a lid top wall 46. The lid rim 44 mates with the base rim 36 to connect the lid 24 to the base 22. The lid rim 44 has an inside wall 48 which is positioned inwardly of the base rim inside wall 38 when the lid is closed on the base. The lid rim inside wall 48 extends upwardly to a lid rim upper wall 50. A lid rim outside wall 52 extends downwardly from the upper wall 50 and terminates in an outwardly extending flange 54.

Figure 3:
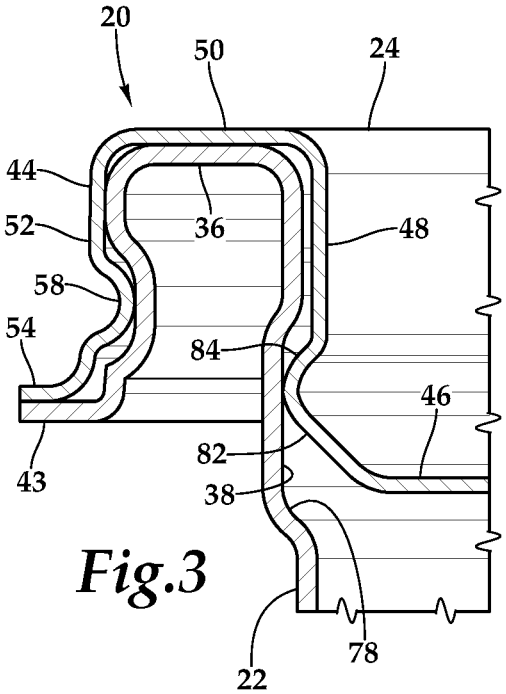
FIG. 3 is a fragmentary cross-sectional view of the container of FIG. 1A taken along section line 3-3.

The base rim 36 and lid rim 44 are each provided with undercut structures on both the interior, offering a spill resistant or liquid tight seal, and on the exterior to give resistance to separating the lid from the base. The base rim outside wall 42 has a concave peripheral groove 56 which opens outwardly and which encircles the base 22. The groove 56 is positioned between the base rim upper wall and the base rim flange 43. Between the lid rim upper wall 50 and the lid rim flange 54, the lid rim outside wall 52 has an inwardly protruding bead 58 which, as shown in FIG. 3, extends into the base rim outside wall groove 56 to retain the lid to the base.

As shown in FIG. 2, although the lid rim sealing bead 58 encircles the majority of the base 22, it does not extend completely around the base. The lid rim sealing bead 58 is interrupted by the pull tab 26. The pull tab 26 includes portions of a lid rim outside wall first segment 60 which is spaced outwardly from a second outside wall segment 62 corresponding to those portions of the outside wall having the sealing bead 58. Bridging sections 64 of the lid rim extend inwardly from the outside wall first segment 60 to the outside wall second segment 62. The bridging sections 64 are positioned sidewardly of the pull tab 26 cut lines 66. As shown in FIG. 1A, there are two cut lines 66 which extend upwardly along the lid rim outside wall and which preferably extend into the upper wall 50 of the lid rim. The cut lines 66 penetrate the thin sheet plastic material of the lid and may have curved portions 67 which extend towards one another along the rim upper wall, as shown in FIG. 1A.

As shown in FIG. 5, as the pull tab 26 is defined to include portions of the first wall segment 60 which lack the outside sealing bead 58, the tab itself does not engage within the base rim outside sealing groove 56. The pull tab 26 is thus retained in its unactuated position as shown in FIG. 5 by two lines of weakened material 68 as shown in FIG. 1B. The lines of weakened material 68 extend from the cut lines 66 and extend along the base rim flange 43. The lines of weakened material 68 could be thinner regions of plastic which are readily torn, but are preferably comprised of perforated plastic defined by through cuts through the plastic alternating with uncut segments of plastic. Each weakened line of material 68 on a second flange portion 72 of the lid terminates in an outwardly opening concave cut-out 69 which defines an outer perimeter of the second flange portion. The concave cut-outs 69 provide curved terminal sides to the tab reducing the presentation of sharp corners to a user engaging the tab.

As shown in FIG. 1A, the lid rim flange 54 has a first portion 70 which substantially corresponds to those portions of the lid rim which have the sealing bead 58. The second flange portion 72 extends outwardly from the outside wall of the pull tab 26. The second flange portions 72 extends outwardly a greater extent than the first flange portion 70. When the lid 24 is mated to the base 22, the first lid flange portion 70 overlies the base rim flange 43 and the lid first flange portion and the base rim flange extend outwardly about the same amount. Because there is no exposure of the lid flange at the first portion 70 it is difficult for a user to access the lid first flange portion. The second lid flange portion 72, however, does extend outwardly substantially beyond the base rim base flange, as shown in FIG. 5, such that the second flange portion is readily accessible by a user. This extension beyond the base flange is sufficient for a user to engage the lid flange, preferably at least 1/16 inch and for full engagement about 3/16 inches.

As shown in FIG. 1A, the second lid flange portion 72 may be marked with indicia 74 giving operational instructions, such as the words "PULL UP". When a user grips the second flange portion 72 of the pull tab and pivots this flange portion upwardly, the two weakened lines of material 68 are severed and the tab 26 may be pivoted upwardly and outwardly. In this condition, the tab 26 can be firmly gripped by the user, and a force applied to overcome the restraining force of the engaged lid bead and base groove and thereby separate the lid 24 from the base 22. This upward pivoting of the pull tab 26 with respect to the remainder of the lid 24 will permanently deform the plastic of the lid, primarily along the lid rim upper wall 50, as shown in FIGS. 6 and 7, generally at a line of bending 74. If the lid 24 is replaced on the base as shown in FIG. 6, the outside engagement between the lid and base will be restored, but the tab 26, which does not have any structure to engage the base rim outside wall groove 56, and which is now severed from its connection to the first segment 70 of the lid flange, cannot be restored to its initial condition. It thus gives clear evidence the lid has been previously been removed after initial sealing, indicating to a prospective purchaser that the container may have been tampered with.

The lid 24 has structure to obtain an inside fit with the base 22. Whenever an inside fit lid is pressed down into a container there is the possibility of the air beneath the closing lid being trapped within the container. If excess air is trapped in the container when the lid is assembled, the container will tend to balloon or bulge outwardly. Not only does this distort the shape of the container, but it will press outwardly on the closure seal between the lid and the base, providing an internal force contributing to the unsealing of the container. Even if this force is moderate, it tends to overcome the closure strength, and make it easier for the lid to be separated from the base without using the designated release tab 26. If there is too much ballooning, a squeeze of the base sidewall from the outside may cause the lid to pop off—an undesirable outcome which would work against the tamper-evident aspect of the container. As shown in FIGS. 1A and 2, the base 22 has multiple vents 28 which allow air to escape during the majority of the assembly process.

As shown in FIG. 2B, the base rim inside wall 38 has an upper lip 76 which extends downwardly from the base rim upper wall 40. An uninterrupted sealing recess 78 is formed as an undercut in the base rim inside wall 38 directly beneath the upper lip 76. The sealing recess 78 projects outwardly and extends around the entire interior of the base. The sealing recess has an upper ledge 80 which extends inwardly and connects the sealing recess to the upper lip 76 rim inside wall. Multiple vents 28 are formed as upwardly extending channels which extend from the sealing recess 78 to the base rim upper wall. Each vent channel communicates between the sealing recess 78 and a region above the base upper wall 40 for the outward flow of air within the interior of the container during the process of closing the lid 24 onto the base 22. The vents 28 are distributed around the interior perimeter of the base and may be spaced approximately equidistant from one another. Although five vents 28 are shown, one, two, three or more may be present.

As shown in FIG. 2A, the lid rim inside wall 48 has an uninterrupted outwardly protruding sealing segment 82 which extends upwardly and outwardly from the lid top wall 46 and is positioned to extend into the base rim sealing recess 78. The lid rim sealing segment 82 has an upwardly facing portion 84 which engages against the base rim sealing recess upper ledge 80 to form an uninterrupted seal therewith as shown in FIGS. 4 and 9. Because this seal is located below the vents 28 when the lid 24 is closed on the base 22, a perimeter seal is maintained.

An alternative embodiment container 120 of the invention is shown in FIGS. 10 and 11 which has a generally rectangular shape, illustrating that the tamper evident structure of the invention may be employed on containers with a variety of plan shapes. The container 120 has a tamper evident lid 124 with a pull tab 126 formed in a portion of the lid rim 144 with cut lines 166 and lines of weakened material 168 on either side of the tab as on the lid 124. The base 122 has a rim, not shown, with a cross-section similar to the one shown on the container 20. The lid rim 144 has a cross-section similar to the one shown on the lid 24, although the lid rim upper wall 150 of the container 120 may be provided with denesting lugs 151. Vents (not shown) may be placed in the base, preferably at least at the corners.

It is understood that the invention is not limited to the particular construction and arrangement of parts herein illustrated and described, but embraces all such modified forms thereof as come within the scope of the following claims.

I claim:

1. A tamper-evident container comprising:

a thermoformed plastic base having a bottom wall and a side wall which extends upwardly from the bottom wall, the side wall and the bottom wall defining a base interior, and wherein a base rim surrounds the base and extends outwardly from the side wall, the base rim having a downwardly extending outside wall positioned outwardly of the side wall of the base, the outside wall of the base rim having portions defining a concave groove which opens outwardly;

a thermoformed plastic lid having a top wall, the top wall having a peripheral rim which mates with the base rim to connect the lid to the base, the peripheral rim having a downwardly extending outside wall positioned outwardly of the base rim outside wall, wherein the peripheral rim of the outside wall of the lid has portions which extend into the concave groove of the outside wall of the base to retain the lid to the base;

portions of the lid which define a first flange portion which extends outwardly and lies above the base rim when the lid is mated to the base;

portions of the lid rim which define a tamper-evident tab, the tab having an outside wall which is spaced from the base rim so as not to engage the concave groove of the outside wall of the base rim, wherein the tab is defined between two upwardly extending cut lines which separate the outside wall of the tab from adjoining portions of the lid rim outside wall;

a second flange portion which extends outwardly from the tab outside wall to extend outwardly beyond a flange extending from the base rim to be accessible by a user to engage the second flange portion of the tab, the second flange portion being connected to the first flange portion on both sides of the tab by weakened lines of material, each weakened line of material extending to one of the two cut lines, wherein the peripheral rim of the lid has an outwardly extending upper wall, and wherein the outside wall of the peripheral rim of the lid extends downwardly from the upper wall, and wherein the two upwardly extending cut lines extend across a portion of the upper wall of the peripheral rim of the lid; and wherein the second flange portion of the tab is engageable by a user to sever the weakened lines of material and pivot the tab upwardly, thereby giving evidence of tampering with the lid closed on the base.

2. The tamper-evident container of claim 1 further comprising:

portions of the base rim which define a base flange which extends outwardly from and terminates the outside wall of the peripheral rim, the base flange extending around the entire base; and wherein the first flange portion of the tab when mated to the base overlies the base flange and wherein the lid first flange portion and the base flange extend outwardly about the same amount, thereby hindering user access to the lid first flange portion, but allowing access to the second flange portion which extends outwardly beyond the base flange of the base rim such that the second flange is accessible by a user.

3. The tamper-evident container of claim 1 wherein the weakened lines of material on either side of the tab where the second flange portion is connected to the first flange portion comprise perforated sections of plastic comprising through cuts through the plastic alternating with uncut segments of plastic.

4. The tamper-evident container of claim 1 further comprising:

a base rim inside wall spaced inwardly of the outside wall of the base rim;

portions of the base rim inside wall which define an outwardly projecting sealing recess that extends around the entire interior of the base, the sealing recess having an uninterrupted upper ledge which extends inwardly and connects the sealing recess to an upper lip segment of the base rim inside wall, the upper lip segment extending upwardly to an upper wall of the base rim which extends outwardly; and portions of the lid rim which define an inside wall positioned inwardly of the base rim inside wall when the lid is closed on the base which define an uninterrupted outwardly protruding sealing segment which extends into the sealing recess of the base rim, the sealing segment of the lid rim having an upwardly facing portion which engages against the upper ledge of the sealing recess of the base rim to form an uninterrupted seal therewith.

5. The tamper-evident container of claim 4 further comprising portions of the base rim which define a plurality of upwardly extending channels which extend from the sealing recess to the upper wall of the base rim, the channels defining vents which communicate between the sealing recess and a region above the upper wall of the base rim for the outward flow of air within the interior of the container during the process of closing the lid onto the base.

6. The tamper-evident container of claim 1 wherein the two cut lines have portions which extend towards one another along the rim upper wall.

7. The tamper-evident container of claim 6 wherein the cut line portions which extend towards each other are curved.

8. The tamper-evident container of claim 1 wherein the lid rim outside wall has a first segment which extends across the tab, and a second segment which surrounds the lid rim away from the tab, and wherein the outside wall first segment has portions spaced outwardly from the outside wall second segment, and wherein bridging sections of the lid rim extend inwardly from the outside wall first segment to the outside wall second segment, the bridging segments being positioned sidewardly from the cut lines.

9. The tamper-evident container of claim 1 wherein each weakened line of material on the second flange portion of the lid terminates in an outwardly opening concave cut-out which defines an outer perimeter of the second flange portion, the concave cut-outs providing curved terminal sides to the tab reducing the presentation of sharp corners to a user engaging the tab.

10. A tamper-evident container comprising:

a thermoformed plastic base having a bottom wall and a side wall which extends upwardly from the bottom wall, the side wall and the bottom wall defining a base interior, wherein a base rim surrounds the base and extends outwardly from the side wall, the base rim having an outwardly extending base flange;

a thermoformed plastic lid having a top wall, the top wall having a peripheral rim which mates with and engages the base rim to connect the lid to the base, the peripheral rim of the lid having portions which define a first flange portion which extends outwardly and lies above the base rim when the lid is mated to the base and does not extend outwardly substantially beyond the base rim;

portions of the lid rim which define a tamper-evident tab, wherein two upwardly extending cut lines extend through the lid rim on each side of the tab; and a second flange portion which extends outwardly from the tab to be accessible by a user to engage the second flange portion of the tab, the second flange portion being connected to the first flange portion on both sides of the tab by weakened lines of material, each weakened line of material extending to one of the two cut lines, wherein the lid rim has an outwardly extending upper wall, and an outside wall extends downwardly from the upper wall of the lid rim, and wherein the two upwardly extending cut lines extend across the outside wall and a portion of the rim upper wall, and wherein the tab second flange portion is engageable by a user to sever the weakened lines of material and pivot the tab upwardly and separate the lid from the base to remove the lid with the first flange portion from its position overlying the base flange, thereby giving evidence of tampering with the lid closed on the base, the lid being returnable to a closed position on the base with the first flange portion overlying the base flange.

11. The tamper-evident container of claim 10 wherein the base flange extends around the entire base.

12. The tamper-evident container of claim 10 wherein the weakened lines of material on either side of the tab where the second flange portion is connected to the first flange portion comprise perforated sections of plastic comprising through cuts through the plastic alternating with uncut segments of plastic.

13. The tamper-evident container of claim 10 further comprising:

portions of the base rim which define an inside wall spaced inwardly of the outside wall of the base rim;

portions of the inside wall of the base rim which define an outwardly projecting sealing recess that extends around the entire interior of the base, the sealing recess having an uninterrupted upper ledge which extends inwardly and connects the sealing recess to an upper lip segment of the inside wall of the base rim, the upper lip segment extending upwardly to an upper wall of the base rim which extends outwardly; and portions of the rim defining an inside wall positioned inwardly of the inside wall of the base rim when the lid is closed on the base which define an uninterrupted outwardly protruding sealing segment which extends into the sealing recess of the base rim, the sealing segment of the lid rim having an upwardly facing portion which engages against the upper ledge of the sealing recess of the base rim to form an uninterrupted seal therewith.

14. The tamper-evident container of claim 13 further comprising portions of the base rim which define a plurality of upwardly extending channels which extend from the sealing recess to the base rim upper wall, the channels defining vents which communicate between the sealing recess and a region above the upper wall for the outward flow of air within the interior of the container during the process of closing the lid onto the base.

15. The tamper-evident container of claim 13 wherein the two cut lines have portions which extend towards one another along the rim upper wall.

16. The tamper-evident container of claim 15 wherein the cut line portions which extend towards each other are curved.

17. The tamper-evident container of claim 10 wherein the lid rim has an outside wall and the outside wall of the lid rim has a first segment which extends across the tab, and a second segment which surrounds the lid rim away from the tab, and wherein the outside wall first segment has portions spaced outwardly from the outside wall second segment, and wherein bridging sections of the lid rim extend inwardly from the first segment of the outside wall of the lid rim to the second segment of the outside wall of the lid rim, the bridging segments being positioned sidewardly from the cut lines.

18. A tamper-evident container comprising:

a thermoformed plastic base having a bottom wall and a side wall which extends upwardly from the bottom wall, the side wall and the bottom wall defining a base interior, wherein a rim surrounds the base and extends outwardly from the side wall, the rim having an outwardly extending base flange;

a thermoformed plastic lid having a top wall, the top wall having a peripheral rim which mates with and engages beneath the rim of the base to connect the lid to the base;

portions of the peripheral rim of the lid which define a tamper-evident tab defined in the peripheral rim of the lid between two upwardly extending cut lines which extend through the peripheral rim of the lid;

portions of the lid which define a lid flange which extends substantially outwardly from the tab, portions of the lid flange being spaced from the underlying base flange of the base rim to facilitate engagement of said lid flange by a user;

portions of the lid flange which define weakened lines of material, one on each side of the tab, and each weakened line of material extending to one of the two upwardly extending cut lines;

wherein the peripheral rim of the lid has an outwardly extending upper wall, and wherein the peripheral rim of the lid has an outside wall which extends downwardly from the upper wall, and wherein the two upwardly extending cut lines extend across a portion of the rim upper wall; and wherein the tab is engageable by a user to sever the weakened lines of material and pivot the tab upwardly, thereby giving evidence of tampering with the lid closed on the base.

19. The tamper-evident container of claim 1 wherein the base and the lid have a generally rectangular shape, and wherein the tab is positioned at a corner of the generally rectangular lid.

20. The tamper-evident container of claim 10 wherein the base and the lid have a generally rectangular shape, and wherein the tab is positioned at a corner of the generally rectangular lid.

* * * * *